United States Patent [19]

Mincher

[11] Patent Number: 5,062,612

[45] Date of Patent: Nov. 5, 1991

[54] SECURITY RAIL

[76] Inventor: William H. Mincher, 2 Eden Road, Bramley, Johannesburg, Transvaal, South Africa

[21] Appl. No.: 555,236

[22] Filed: Jul. 19, 1990

[30] Foreign Application Priority Data

Jul. 20, 1989 [ZA] South Africa ..... 89/5530

[51] Int. Cl.[5] ..... E04H 17/00

[52] U.S. Cl. ..... 256/11; 256/8

[58] Field of Search ..... 256/11, 8

[56] References Cited

U.S. PATENT DOCUMENTS

| | | | |
|---|---|---|---|
| 185,593 | 12/1876 | Topliff | 256/11 |
| 367,893 | 8/1987 | Cloud . | |
| 2,306,080 | 12/1942 | Peles | 256/11 X |
| 4,328,955 | 5/1982 | Hermans | 256/8 |
| 4,832,316 | 5/1989 | Mincher | 256/11 |
| 4,844,422 | 7/1989 | Major | 256/8 |

FOREIGN PATENT DOCUMENTS

| | | |
|---|---|---|
| 81/3239 | 5/1981 | South Africa . |
| 86/7225 | 9/1986 | South Africa . |
| 87/0233 | 1/1987 | South Africa . |

*Primary Examiner*—Andrew V. Kundrat

*Attorney, Agent, or Firm*—Ladas & Parry

[57] ABSTRACT

The invention provides an elongate security rail comprising a land extending in the long direction of the rail and which is connectable to the top edge of a wall or the frame of a framed fence. A series of barbed palings one spaced apart on one side of the land, and a series of spikes one spaced apart on the opposite side of the land. The land, palings and spikes are formed integrally from a strip of flat metal and subsequently bent so as to project in a generally upward direction when the land is connected to the wall. This invention also provides a method of making such a security rail.

3 Claims, 2 Drawing Sheets

Fig. 1
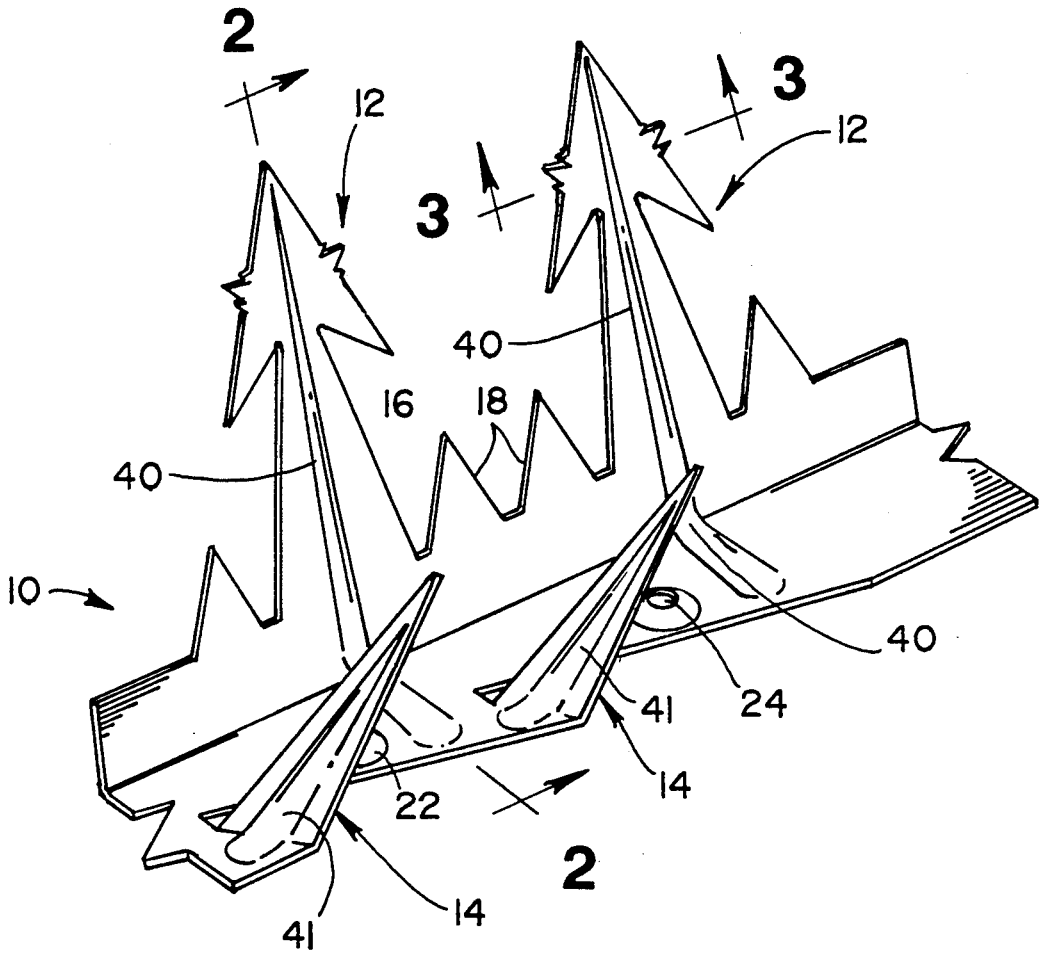
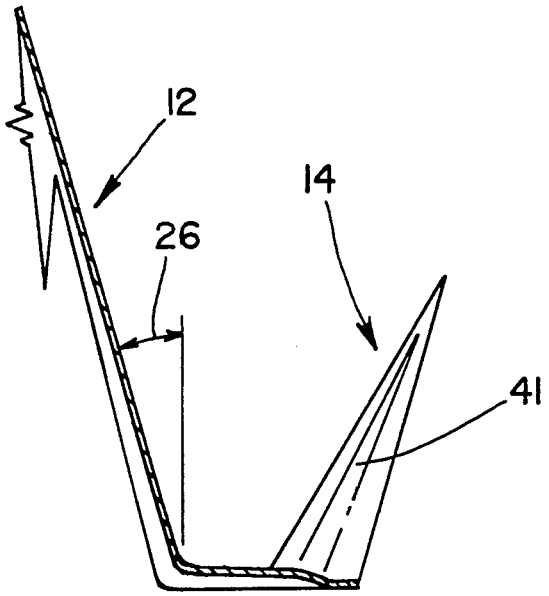
Fig. 2

SECURITY RAIL

BACKGROUND TO THE INVENTION

This invention relates to a security rail which can be fixed to the top edge of a perimeter wall or fence frame to provide a deterrent to would-be intruders.

Many different types of security rail for this purpose are already known. However, the majority of known rails lack "bulk". In other words, the rails are relatively narrow and do not have any substantial transverse dimension with the result that their deterrent effect is limited.

SUMMARY OF THE INVENTION

A first aspect of the invention provides an elongate security rail comprising a land extending in the long direction of the rail and being connectable to the top edge of a wall or fence frame, a first series of spikes in the form of barbed palings spaced apart along the length of the rail and situated to one side of the land, and a second series of spikes spaced apart along the length of the rail and situated to the opposite side of the land, the security rail being formed integrally from one of two identical, mirror image blanks which are produced from a single strip of flat metal, the blank including palings, spikes and the land, and the palings and spikes being bent up relative to the land so as to project from opposite sides of the land.

Preferably the palings have arrow-head shapes and are spaced apart, on the revelant side of the land, by further spikes which are also bent up out of the plane of the flap metal strip.

In the preferred embodiment, all spikes, except those in the form of barbed palings have a generally triangular shape.

For added strength, the barbed palings may have a V-shape in cross-section. A second aspect of the invention provides a method of making a security rail out of a flat metal strip, the method comprising removing metal from the strip to form two mirror image blanks each including a first series of spaced apart spikes in the form of barbed palings, a second series of spikes and a land between the first series and the second series, the spikes of the second series being formed by making spaced apart, parallel cuts in one long edge of the metal strip, such cuts extending into the strip at an acute angle to that edge of the strip, and the security rail being formed from the blank by bending the palings and the spikes relative to the land so that they project from opposite sides of the land.

BRIEF DESCRIPTION OF THE DRAWINGS

The invention will now be described in more detail, by way of example only, with reference to the accompanying drawings in which:

FIGS. 1 shows a perspective view of a length of security rail of the invention;

FIG. 2 show a cross-section at the line 2-2 in FIG. 1;

DESCRIPTION OF A PREFERRED EMBODIMENT

Figure 3:
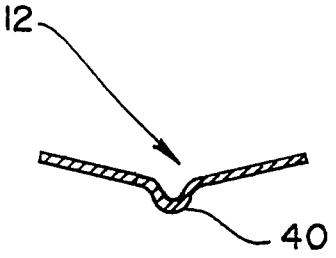
FIG. 3 shows a cross-section at the line 3-3 in FIG. 1.

The elongate security rail 10 seen partially in FIG. 1 has a series of barbed palings 12 and a series of generally triangular spikes 14 on opposite sides of a generally flat central land 16. The palings are arrow-shaped and alternate with pairs of further triangular spikes 18. The central land 16 has a series of raised formations 22 which are formed with holes 24 through which fasteners can be passed to secure the land to the top edge of a wall (not shown) or to an upper frame member of a fence frame.

As illustrated in FIG. 2, the palings 12 project upwardly from the land at an angle 26 to the vertical of approximately 15°. The spikes 14 also project in a generally upward direction from the land, in this case at an angle of about 45° to the vertical.

Figure 4:
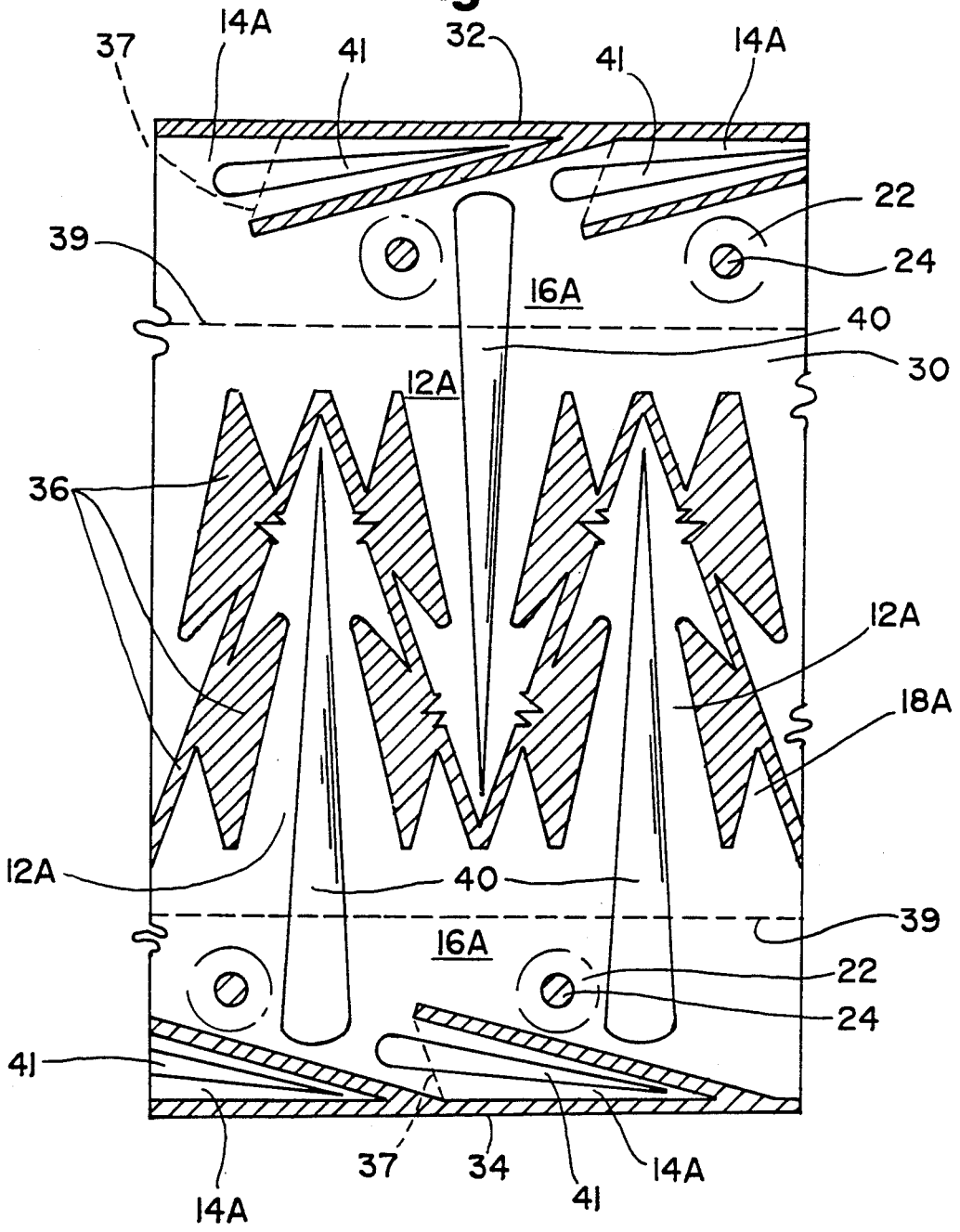
FIG. 4 shows how the security rail is formed from a flat metal strip.

FIG. 4 shows a flat metal strip 30 from which the land, palings and spikes are formed integrally. The strip has opposite long edges 32 and 34 and is of mild or corrosion-resistant steel. The strip is passed through metal cutting and pressing equipment which removes metal in the shaded areas 36, the removed metal going to scrap. The metal removal step can be conducted in a series of sequential steps, with portions of the shaded areas being removed at each step. It will be seen that the strip is effectively divided longitudinally in two pieces, with each of the two pieces being a mirror image of the other. Subject to what is said below about the ribs 40 and 41 and the raised areas 22, the metal at this stage is still generally in one plane.

Each of the two pieces or blanks into which the strip is divided has a land 16A, spaced apart palings 12A of arrow-shape and spaced apart triangular spikes 14A. The palings 12A are spaced apart by the pairs of triangular spikes 18A.

The metal pressing and cutting equipment also forms strengthening ribs 40 and 41 in the palings 12A and in the spikes 14A, and the raised areas 22 and holes 24 in the land 16A. In addition, the palings 12A are given a curved V-shaped cross-section as illustrated by FIG. 3.

In the next stage of the manufacturing process, the palings 12A and spikes 14A and 18A are bent up, out of the plane of the original metal strip, about the lines 37 and 39, to form the palings and spikes 12, 14 and 18 as seen in FIG. 1.

The strengthening ribs 40 and 41 straddle the bend lines and give the palings and spikes added resistance to reverse bending. The V-shaped cross-section of the palings also improves their resistance to bending. The spikes 14 may have similar cross-sectional shapes to the palings so that their resistance to reverse bending is also improved.

In use of the resultant security railing, the land 16 is fixed to the top edge of a wall, or to an upper frame member of a fence frame, by means of suitable fasteners passing through the holes 24. The railing has considerable bulk. This is provided by the fact that the palings and spikes do not project vertically uprwardly from the land, but also laterally to some extent. Thus the security railing provides a deterrent both on top of the wall or the fence and also to some degree to the sides.

I claim:

1. An elongate security rail comprising a land extending in the long direction of the rail and being connectable to the top edge of a wall or fence frame, a first series of spikes in the form of barbed palings spaced apart along the length of the rail and situated to one side of the land, and a second series of spikes spaced apart along the length of the rail and situated to the opposite side of the land, the security rail being formed integrally from one of two identical, mirror image blanks which are produced from a single strip of flat metal, the blank including palings, spikes and the land, and the palings and spikes being bent up relative to the land so as to project from the opposite sides of the land and the barbed palings having arrowhead shapes and being spaced apart, on the relevant side of the land, by further spikes which are also bent up out of the plane of the flat metal strip.

2. An elongate security rail according to claim 1, wherein all the spikes except those in the form of barbed palings have a generally triangular shape.

3. An elongate security rail according to claim 1 wherein the barbed palings have a V-shaped in cross-section.

* * * * *